US009839109B1

(12) United States Patent
Leray

(10) Patent No.: US 9,839,109 B1
(45) Date of Patent: Dec. 5, 2017

(54) DYNAMIC CONTROL BAND FOR RF PLASMA CURRENT RATIO CONTROL

(71) Applicant: APPLIED MATERIALS, INC., Santa Clara, CA (US)

(72) Inventor: Gary Leray, Mountain View, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 15/212,485

(22) Filed: Jul. 18, 2016

Related U.S. Application Data

(60) Provisional application No. 62/343,069, filed on May 30, 2016.

(51) Int. Cl.
*H05H 1/46* (2006.01)

(52) U.S. Cl.
CPC ..... *H05H 1/46* (2013.01); *H05H 2001/4645* (2013.01)

(58) Field of Classification Search
CPC .... H01J 37/321; H01J 37/32174; H05H 1/46; H05H 2001/4645
USPC ..... 315/111.21
See application file for complete search history.

(56) References Cited

U.S. PATENT DOCUMENTS 6,507,155 B1 1/2003 Barnes et al.
6,617,794 B2 9/2003 Barnes et al.
8,264,154 B2 9/2012 Banna et al.
9,515,633 B1 * 12/2016 Long ..... H03H 7/38
2002/0041160 A1 * 4/2002 Barnes ..... H01J 37/321 315/111.21
2003/0006008 A1 * 1/2003 Horioka ..... H01J 37/32623 156/345.46
2007/0009405 A1 * 1/2007 Hatakeyama ..... B82Y 30/00 422/186.04
2010/0314048 A1 * 12/2010 Long ..... H01J 37/321 156/345.48
2011/0115379 A1 * 5/2011 Long ..... H01J 37/321 315/111.21
2012/0247679 A1 * 10/2012 Yamazawa ..... H01J 37/321 156/345.48
2013/0134129 A1 5/2013 Todorow et al.

OTHER PUBLICATIONS

U.S. Appl. No. 15/007,818, filed Jan. 27, 2016, Kawasaki et al.
U.S. Appl. No. 15/212,879, filed Jul. 18, 2016, Kawasaki et al.
U.S. Appl. No. 14/882,878, filed Oct. 14, 2015, Kawasaki et al.
U.S. Appl. No. 14/886,891, filed Oct. 19, 2015, Kawasaki et al.

* cited by examiner

*Primary Examiner* — Don Le
(74) *Attorney, Agent, or Firm* — Moser Taboada; Alan Taboada

(57) ABSTRACT

Methods and apparatus for plasma processing are provided herein. The method for controlling current ratio in a substrate processing chamber may include (a) providing a first RF signal to a first RF coil and a second RF coil at a first current ratio set point and a first current operating mode, (b) determining a first dynamic control limit for the first current ratio set point based on a value of the first current ratio set point and the first current operating mode, (c) measuring an amount of current supplied to each of the first and second coils, (d) determining the actual current ratio based on the measured amounts of current supplied to each of the first and second coils, (e) determining whether the actual current ratio determined is within the dynamic control limits, and (f) repeating steps (b)-(e) until the actual current ratio determined is within the dynamic control limits.

20 Claims, 3 Drawing Sheets

DYNAMIC CONTROL BAND FOR RF PLASMA CURRENT RATIO CONTROL

CROSS-REFERENCE TO RELATED APPLICATIONS

This application claims benefit of U.S. provisional patent application Ser. No. 62/343,069, filed May 30, 2016, which is herein incorporated by reference in its entirety.

FIELD

Embodiments of the present disclosure generally relate to plasma processing equipment.

BACKGROUND

Inductively coupled plasma (ICP) process reactors generally form plasmas by inducing current in a process gas disposed within the process chamber via one or more inductive coils disposed outside of the process chamber. The inductive coils may be disposed externally and separated electrically from the chamber by, for example, a dielectric lid. When radio frequency (RF) current is fed to the inductive coils via an RF feed structure from an RF power supply, an inductively coupled plasma can be formed inside the chamber from an electric field generated by the inductive coils.

In some reactor designs, the reactor may be configured to have concentric inner and outer inductive coils. RF power from an RF power source may be split between the two coils via a current divider/variable capacitor, or the like. In some reactors, the power from a RF power source may be coupled through a dynamically tuned matching network (also referred to as a match unit) to an antenna or electrode within the reactor. The RF power is coupled from the antenna or electrode to process gases within the reactor to form a plasma that is used for the etching process. The matching network ensures that the output of the RF source is efficiently coupled to the plasma to maximize the amount of energy coupled to the plasma (e.g., referred to as tuning the RF power delivery). Tuning refers to the process of varying (e.g., tuning) the impedance of the electrical pathway seen by the RF source (i.e., plasma impedance+chamber impedance+matching network impedance) in order to minimize power reflected back to the RF power source from the plasma and maximize efficient coupling of power from the RF power source to the plasma.

Existing reactor designs focus on ways to rapidly minimize the amount of reflected power (i.e., controlling the reflected power) to tune the system. By contrast the inventor has recognized that by controlling the current ratio between the two coils, rather than focusing on reflected power, more effective tuning can be achieved in certain situations. However, in existing solutions involving tuning using current ratio control, the limits of the current ratio are fixed for each operating mode (standard/forward current mode and reverse mode).

Accordingly, the inventors have devised a plasma process method and apparatus to better control current ratio.

SUMMARY

Methods and apparatus for plasma processing are provided herein. The method for controlling current ratio in a substrate processing chamber may include (a) providing a first RF signal to a first RF coil and a second RF coil at a first current ratio set point and a first current operating mode, (b) determining a first dynamic control limit for the first current ratio set point based on a value of the first current ratio set point and the first current operating mode, (c) measuring an amount of current supplied to each of the first and second coils, (d) determining the actual current ratio based on the measured amounts of current supplied to each of the first and second coils, (e) determining whether the actual current ratio determined is within the dynamic control limits, and (f) repeating steps (b)-(e) until the actual current ratio determined is within the dynamic control limits.

In some embodiments, the method for controlling current ratio in a substrate processing chamber may include (a) providing a first RF signal from an RF source through a first RF coil and a second RF coil at a first current ratio set point and a first divider capacitor position; (b) determining a first dynamic control limit for the first current ratio set point based on a value of the first current ratio set point and the first divider capacitor position, wherein the first dynamic control limit is a derivative of the first current ratio set point versus the first divider capacitor position; (c) measuring an amount of current supplied to each of the first and second coils; (d) determining the actual current ratio based on the measured amounts of current supplied to each of the first and second coils; (e) determining whether the actual current ratio determined is within the dynamic control limits; and (f) repeating steps (b)-(e) until the actual current ratio determined is within the dynamic control limits.

In some embodiments, a non-transitory computer readable medium, having instructions stored thereon that, when executed, cause a method for controlling current ratio in a substrate processing chamber is provided. The method include (a) providing a first RF signal to a first RF coil and a second RF coil at a first current ratio set point and a first current operating mode, (b) determining a first dynamic control limit for the first current ratio set point based on a value of the first current ratio set point and the first current operating mode, (c) measuring an amount of current supplied to each of the first and second coils, (d) determining the actual current ratio based on the measured amounts of current supplied to each of the first and second coils, (e) determining whether the actual current ratio determined is within the dynamic control limits, and (f) repeating steps (b)-(e) until the actual current ratio determined is within the dynamic control limits.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. It is to be noted, however, that the appended drawings illustrate only typical embodiments of this disclosure and are therefore not to be considered limiting of its scope, for the disclosure may admit to other equally effective embodiments.

Figure 1:
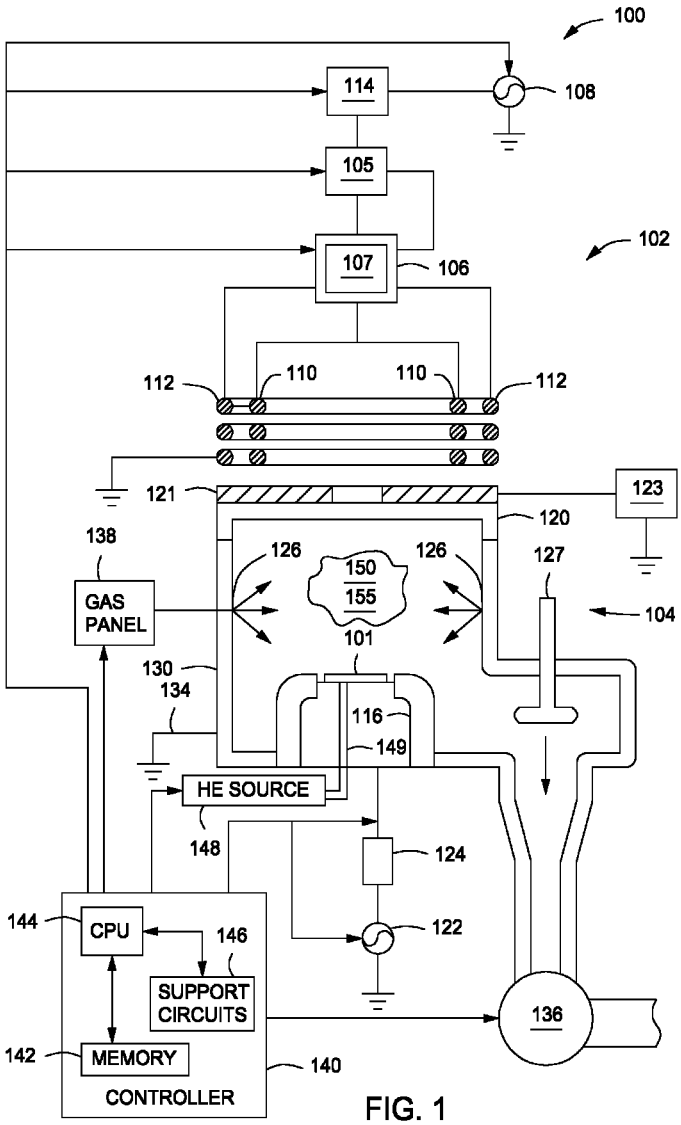
FIG. 1 depicts a process chamber suitable to perform a method for controlling current ratio in accordance with some embodiments of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Methods and apparatus for plasma processing are provided herein. The inventive methods and plasma processing apparatus advantageously provides active current ratio control during plasma etch processes. Embodiments of the inventive active current ratio control methods described herein may be used in any RF plasma systems where the current ratio is controlled. For example, the active current ratio control methods may be used in RF plasma systems having dual output sources split by a current divider capacitor.

Embodiments of the active current ratio control methods control/optimize the current ratio with respect to a set point. The derivative of current ratio as a function of divider capacitor position, which acts as a power divider, is not a constant across the current ratio range. Thus, to get the best performance in matching the current ratio reading to the current ratio set point, the control limit of a current ratio tuning algorithm needs to be changed in real-time as the current ratio set point is being changed. Embodiments of the inventive active current ratio control method are described below in further detail with respect to FIGS. 1-3.

FIG. 1 depicts a schematic side view of an exemplary inductively coupled plasma reactor (reactor 100) in accordance with some embodiments of the present disclosure. Although embodiments consistent with the present disclosure are described herein with respect to inductively coupled plasma reactor, embodiments consistent with the present disclosure may be used in conjunction with any chamber with a dual output split via variable capacitor (e.g., a divider capacitor).

The reactor 100 may be utilized alone or, as a processing module of an integrated semiconductor substrate processing system, or cluster tool, such as a CENTRIS™ SYM3™ integrated semiconductor wafer processing system, available from Applied Materials, Inc. of Santa Clara, Calif. Examples of suitable plasma reactors that may advantageously benefit from modification in accordance with embodiments of the present disclosure include inductively coupled plasma etch reactors such as the MESA™, CENTURA® or DPS® line of semiconductor equipment (such as the DPS®, DPS® II, DPS® AE, DPS® G3 poly etcher, DPS® G5, or the like) also available from Applied Materials, Inc. The above listing of semiconductor equipment is illustrative only, and other etch reactors, and non-etch equipment (such as CVD reactors, or other semiconductor processing equipment) may also be suitably modified in accordance with the present teachings.

The reactor 100 includes an inductively coupled plasma apparatus 102 disposed atop a process chamber 104. The inductively coupled plasma apparatus includes an RF feed structure 106 for coupling an RF power supply 108 to a plurality of RF coils, e.g., a first RF coil 110 and a second RF coil 112. The plurality of RF coils are coaxially disposed proximate the process chamber 104 (for example, above the process chamber) and are configured to inductively couple RF power into the process chamber 104 to form a plasma from process gases provided within the process chamber 104.

The RF power supply 108 is coupled to the RF feed structure 106 via a match network 114. A divider capacitor 105 is provided to adjust the RF power respectively delivered to the first and second RF coils 110, 112. The divider capacitor 105 is a variable capacitor that controls the current ratio of the RF current flowing through each of the first and second RF coils 110, 112. The amount of current flowing through each of the first and second RF coils 110, 112 may be measured by a current sensor included in one or more of the match network 114, the divider capacitor 105, and/or the RF feed structure 106. The divider capacitor 105 may be coupled between the match network 114 and the RF feed structure 106. Alternatively, the divider capacitor may be a part of the match network 114, in which case the match network will have two outputs coupled to the RF feed structure 106—one corresponding to each RF coil 110, 112.

For example, one or more current sensors 107 may be provided as part of the RF feed structure 106. In some embodiments, a current sensor 107 may be provided for each output that measures the current. The values sensed by the sensors are provided to a controller, such as a controller in the impedance matching network, the controller 140 discussed below, or some other similar controller. The controller 140 calculates the actual current ratio and compares the actual ratio to the desired ratio (for example, a set point from the recipe on the tool). The controller may then adjust the divider capacitor 105 to match the measurement (the actual current ratio) to the set point (the desired current ratio) within the dynamic control limits determined for each set point, as described below in further detail.

The RF feed structure 106 couples the RF current from the divider capacitor 105 (or the match network 114 where the divider capacitor is incorporated therein) to the respective RF coils. In some embodiments, the RF feed structure 106 may be configured to provide the RF current to the RF coils in a symmetric manner, such that the RF current is coupled to each coil in a geometrically symmetric configuration with respect to a central axis of the RF coils, such as by a coaxial structure.

The reactor 100 generally includes the process chamber 104 having a conductive body (wall) 130 and a dielectric lid 120 (that together define a processing volume), a substrate support pedestal 116 disposed within the processing volume, the inductively coupled plasma apparatus 102, and a controller 140. The wall 130 is typically coupled to an electrical ground 134. In some embodiments, the support pedestal 116 may provide a cathode coupled through a matching network 124 to a biasing power source 122. The biasing source 122 may illustratively be a source of up to 1000 W at a frequency of approximately 13.56 MHz that is capable of producing either continuous or pulsed power, although other frequencies and powers may be provided as desired for particular applications. In other embodiments, the source 122 may be a DC or pulsed DC source.

In some embodiments, a link (not shown) may be provided to couple the RF power supply 108 and the biasing source 122 to facilitate synchronizing the operation of one source to the other. Either RF source may be the lead, or master, RF generator, while the other generator follows, or is the slave. The link may further facilitate operating the RF power supply 108 and the biasing source 122 in perfect synchronization, or in a desired offset, or phase difference. The phase control may be provided by circuitry disposed within either or both of the RF source or within the link between the RF sources. This phase control between the source and bias RF generators (e.g., 108, 122) may be provided and controlled independent of the phase control over the RF current flowing in the plurality of RF coils coupled to the RF power supply 108.

In some embodiments, the dielectric lid 120 may be substantially flat. Other modifications of the chamber 104 may have other types of lids such as, for example, a dome-shaped lid or other shapes. The inductively coupled plasma apparatus 102 is typically disposed above the lid 120 and is configured to inductively couple RF power into the process chamber 104. The inductively coupled plasma apparatus 102 includes the first and second coils 110, 112, disposed above the dielectric lid 120. The relative position, ratio of diameters of each coil, and/or the number of turns in each coil can each be adjusted as desired to control, for example, the profile or density of the plasma being formed via controlling the inductance on each coil. Each of the first and second coils 110, 112 is coupled through the matching network 114 via the RF feed structure 106, to the RF power supply 108. The RF power supply 108 may illustratively be capable of producing up to 4000 W at a tunable frequency in a range from 50 kHz to 13.56 MHz, although other frequencies and powers may be provided as desired for particular applications.

Returning to FIG. 1, optionally, one or more electrodes (not shown) may be electrically coupled to one of the first or second coils 110, 112, such as the first coil 110. The one or more electrodes may be two electrodes disposed between the first coil 110 and the second coil 112 and proximate the dielectric lid 120. Each electrode may be electrically coupled to either the first coil 110 or the second coil 112, and RF power may be provided to the one or more electrodes via the RF power supply 108 via the inductive coil to which they are coupled (e.g., the first coil 110 or the second coil 112).

In some embodiments, the one or more electrodes may be movably coupled to one of the one or more inductive coils to facilitate the relative positioning of the one or more electrodes with respect to the dielectric lid 120 and/or with respect to each other. For example, one or more positioning mechanisms may be coupled to one or more of the electrodes to control the position thereof. The positioning mechanisms may be any suitable device, manual or automated, that can facilitate the positioning of the one or more electrodes as desired, such as devices including lead screws, linear bearings, stepper motors, wedges, or the like. The electrical connectors coupling the one or more electrodes to a particular inductive coil may be flexible to facilitate such relative movement. For example, in some embodiments, the electrical connector may include one or more flexible mechanisms, such as a braided wire or other conductor.

A heater element 121 may be disposed atop the dielectric lid 120 to facilitate heating the interior of the process chamber 104. The heater element 121 may be disposed between the dielectric lid 120 and the first and second coils 110, 112. In some embodiments, the heater element 121 may include a resistive heating element and may be coupled to a power supply 123, such as an AC power supply, configured to provide sufficient energy to control the temperature of the heater element 121 to be between about 50 to about 100 degrees Celsius. In some embodiments, the heater element 121 may be an open break heater. In some embodiments, the heater element 121 may comprise a no break heater, such as an annular element, thereby facilitating uniform plasma formation within the process chamber 104.

During operation, a substrate 114 (such as a semiconductor wafer or other substrate suitable for plasma processing) may be placed on the pedestal 116 and process gases may be supplied from a gas panel 138 through entry ports 126 to form a gaseous mixture 150 within the process chamber 104. The gaseous mixture 150 may be ignited into a plasma 155 in the process chamber 104 by applying power from the RF source 108 to the first and second coils 110, 112 and optionally, the one or more electrodes (not shown). In some embodiments, power from the bias source 122 may be also provided to the pedestal 116. The pressure within the interior of the chamber 104 may be controlled using a throttle valve 127 and a vacuum pump 136. The temperature of the chamber wall 130 may be controlled using liquid-containing conduits (not shown) that run through the wall 130.

The temperature of the substrate 101 may be controlled by stabilizing a temperature of the support pedestal 116. In one embodiment, helium gas from a gas source 148 may be provided via a gas conduit 149 to channels defined between the backside of the substrate 101 and grooves (not shown) disposed in the pedestal surface. The helium gas is used to facilitate heat transfer between the pedestal 116 and the substrate 101. During processing, the pedestal 116 may be heated by a resistive heater (not shown) within the pedestal to a steady state temperature and the helium gas may facilitate uniform heating of the substrate 101. Using such thermal control, the substrate 101 may illustratively be maintained at a temperature of between 0 and 500 degrees Celsius.

The controller 140 comprises a central processing unit (CPU) 144, a memory 142, and support circuits 146 for the CPU 144 and facilitates control of the components of the reactor 100 and, as such, of methods of forming a plasma, such as discussed herein. The controller 140 may be one of any form of general-purpose computer processor that can be used in an industrial setting for controlling various chambers and sub-processors. The memory, or computer-readable medium, 142 of the CPU 144 may be one or more of readily available memory such as random access memory (RAM), read only memory (ROM), floppy disk, hard disk, or any other form of digital storage, local or remote. The support circuits 446 are coupled to the CPU 144 for supporting the processor in a conventional manner. These circuits include cache, power supplies, clock circuits, input/output circuitry and subsystems, and the like. The inventive method may be stored in the memory 142 as software routine that may be executed or invoked to control the operation of the reactor 100 in the manner described above. The software routine may also be stored and/or executed by a second CPU (not shown) that is remotely located from the hardware being controlled by the CPU 144.

The controller 140 controls the RF power supply 108, the matching network 114, the divider capacitor, and/or elements of the RF feed structure 106 to provide the desired current ratio base on measured current through the first and second RF coils 110, 112. The first and second RF coils 110, 112 can be configured such that the phase of the RF current flowing through the first RF coil can be out of phase with respect to the phase of the RF current flowing through the RF second RF coil. As used herein, the term "out of phase" can be understood to mean that the RF current flowing through the first RF coil is flowing in an opposite direction to the RF current flowing through the second RF coil, or that the phase of the RF current flowing through the first RF coil is shifted with respect to the RF current flowing through the second RF coil.

As noted above, the divider capacitor 105 is provided between the RF feed structure 106 to control the relative quantity of RF power provided by the RF power supply 108 to the respective first and second coils. For example, as shown in FIG. 1, a divider capacitor 105 may be disposed in the line coupling the RF feed structure 106 to the RF power supply 108 for controlling the amount of RF power provided to each coil (thereby facilitating control of plasma characteristics in zones corresponding to the first and second coils). In some embodiments, the divider capacitor 105 may be incorporated into the match network 114. In some embodiments, after the divider capacitor 105, RF current flows to flows to the RF feed structure 106 where it is distributed to the first and second RF coils 110, 112.

By actively adjusting the current ratio, the inventor has discovered that undesired processing non-uniformities (such as the M-shape etch profile of a substrate surface) may advantageously be controlled. In embodiments consistent with the present disclosure, the active current ratio control methods control/optimize the current ratio with respect to a set point.

Figure 2A:
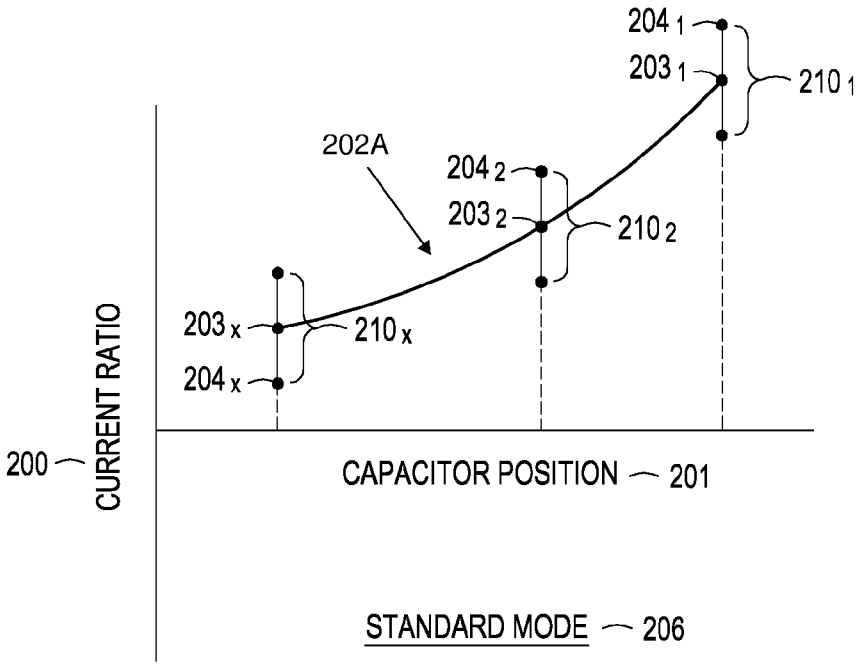
FIGS. 2A and 2B depict graphs showing current ratio as a function of capacitor position including dynamic control bands for RF plasma current ratio control in accordance with some embodiments of the present disclosure.
Figure 2B:
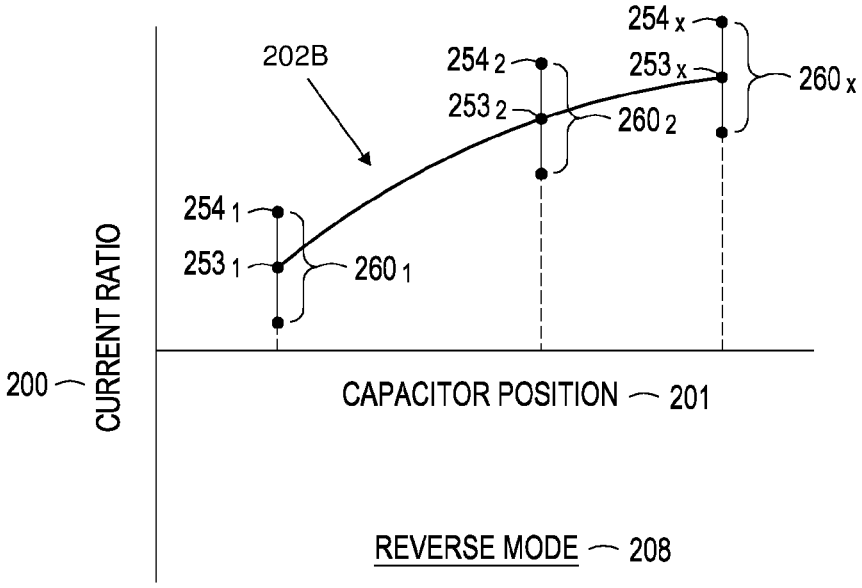

Specifically, FIGS. 2A and 2B depict graphs showing current ratio as a function of capacitor position including dynamic control bands for RF plasma current ratio control in accordance with some embodiments of the present disclosure. More specifically, FIG. 2A depicts a plot 202A of current ratio 200 as a function of capacitor position 201 in standard mode 206. The divider capacitor will be adjusted to provide a current ratio at, or close to, a first current ratio set point $\mathbf{203}_1$. The current ratio set points $\mathbf{203}_1$-$\mathbf{203}_x$ will be used to determine the active dynamic control limits $\mathbf{204}_1$-$\mathbf{204}_x$ that are used to assist in controlling the current ratio in accordance with some embodiments of the present disclosure. Each dynamic control limit $\mathbf{204}_1$-$\mathbf{204}_x$ defines an error range 210 for the control limits which is a derivative of current ratio as a function of divider capacitor position. The higher the derivative of current ratio as a function of divider capacitor position, the larger the control limit error ranges. When the measured current ratio is within the dynamic control limit error range 210, the controller will stop controlling. As the etch process uses a new current ratio set point (e.g., $\mathbf{203}_2$), a dynamic control limit $\mathbf{204}_2$ and associated error range $\mathbf{210}_2$ will be determined based on the tuning algorithm for that set point and current operating mode (i.e., standard or reverse current operating mode).

Similarly, FIG. 2B depicts a plot 202B of current ratio 200 as a function of capacitor position 201 in reverse mode 208. The divider capacitor will be adjusted to provide a current ratio at, or close to, a first current ratio set point $\mathbf{253}_1$. The current ratio set points $\mathbf{253}_1$-$\mathbf{253}_x$ will be used to determine the active dynamic control limits $\mathbf{254}_1$-$\mathbf{254}_x$ that are used to assist in controlling the current ratio in accordance with some embodiments of the present disclosure. Each dynamic control limit $\mathbf{254}_1$-$\mathbf{254}_x$ defines an error range 260 for the control limits which is a derivative of current ratio as a function of divider capacitor position. The higher the derivative of current ratio as a function of divider capacitor position, the larger the control limit error ranges. When the measured current ratio is within the dynamic control limit error range 260, the controller will stop controlling. As the etch process uses a new current ratio set point (e.g., $\mathbf{253}_2$), a dynamic control limit $\mathbf{254}_2$ and associated error range $\mathbf{260}_2$ will be determined based on the tuning algorithm for that set point and current operating mode (i.e., standard or reverse current operating mode).

As shown in FIGS. 2A and 2B, the derivative of the current ratio as a function of divider capacitor position is not a constant across the current ratio range. Thus, to get the best performance in matching the current ratio reading to the current ratio set point, the control limit of a current ratio tuning algorithm needs to be changed in real-time as the current ratio set point is being changed. The function controlling the dynamic control limits $\mathbf{204}_1$-$\mathbf{204}_x$ and $\mathbf{254}_1$-$\mathbf{254}_x$ depends on the RF source mode (i.e., standard/forward current mode or reverse current mode) and current ratio set point.

Figure 3:
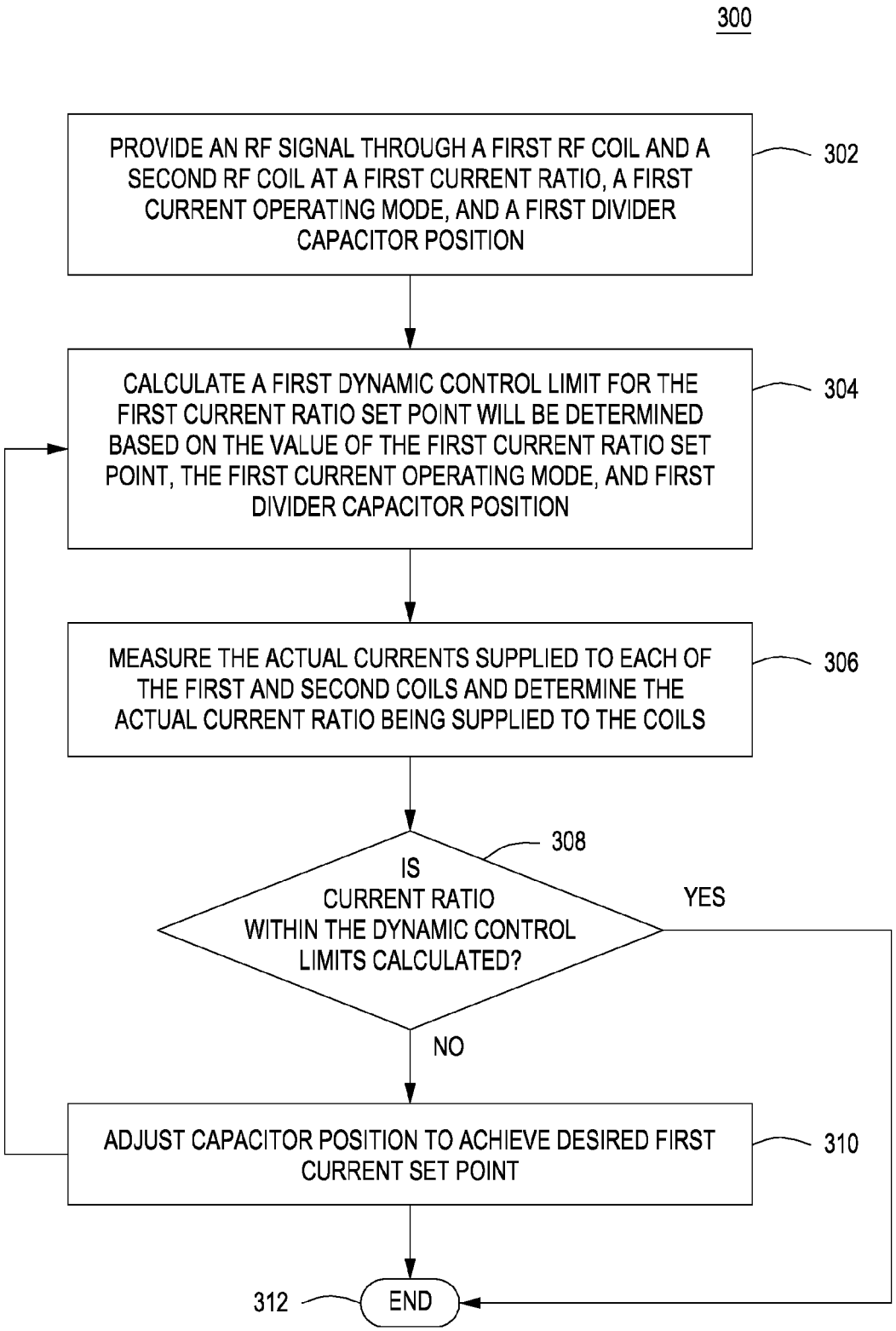
FIG. 3 depicts a flow chart of a method for controlling the current ratio in accordance with some embodiments of the present disclosure.

FIG. 3 depicts a flow chart of a method for controlling the current ratio in accordance with some embodiments of the present disclosure. The method 300 is described below in accordance with embodiments of the disclosure illustrated in FIGS. 1-3, however, the method 300 can be applied with any embodiments of the disclosure described herein. The method 300 is performed by the controller 140 which controls the RF power supply 108, the matching network 114, the divider capacitor, and/or elements of the RF feed structure 106 to provide the desired current ratio base on measured current through the first and second RF coils 110, 112.

The method 300 begins at 302 by providing a first RF signal through the first RF coil 110 and the second RF coil 112 in a first current operating mode (e.g., a standard current operating mode, a reverse current operating mode, etc.). The first RF signal provided will be based on a first current ratio set point that is part of the process recipe. The divider capacitor will be moved to a first divider capacitor position to achieve the desired current ratio set point. The RF signals may be provided at any suitable frequency desired for a particular application. Exemplary frequencies include but are not limited to, a frequency of between about 100 kHz to about 60 MHz. The RF signal may be provided at any suitable power, such as up to about 5000 Watts.

At 304, the derivative of the current ratio versus the divider capacitor position are calculated at the first set point (e.g., at $\mathbf{203}_1$ in FIG. 2). That is, a first dynamic control limit $\mathbf{204}_1$ for the first current ratio set point $\mathbf{203}_1$ are determined/calculated based on the value of the first current ratio set point $\mathbf{203}_1$, the first current operating mode, and/or first divider capacitor position.

At 306, the actual currents supplied to each of the first and second coils 110, 112 are measured and the actual current ratio is determined. In some embodiments, the currents supplied to each of the first and second coils 110, 112 are measured using sensors 107, and the current ratio may be calculated by controller 140.

At 308, it is determined whether the actual current ratio determined is within the dynamic control limit $\mathbf{204}_1$ range. If the actual current ratio determined from the measured currents is within the dynamic control limit $\mathbf{204}_1$ calculated, the controller 140 stops adjusting the current ratio using the divider capacitor and the process with end at 312.

If the actual current ratio determined from the measured currents is not within the dynamic control limit $\mathbf{204}_1$ calculated, the controller 140 will adjust the divider capacitor to attempt to achieve the desired first current set point for the process recipe at 310. In some embodiments, once the divider capacitor position is changed, new dynamic control limits will need to be calculated, so the method returns to 304 and proceeds again until the measured current ratio is within the dynamic control limit $\mathbf{204}_1$ calculated.

In some embodiments, the sensors 107 will continually monitor the currents provided to each coil until the current ratio set point is changed, or until the actual current ratio measured falls outside of the dynamic control limit $\mathbf{204}_1$ calculated for the desired current ratio set point (e.g., at $\mathbf{203}_1$). The actual current ratio is continually being calculated using updated current values measured by the one or more current sensors. If either of these conditions is sensed/ determined, the method begins again at 302 using the second current ratio set point (e.g., at $\mathbf{203}_2$), a second divider capacitor position, and a second current operating mode.

While the foregoing is directed to embodiments of the present disclosure, other and further embodiments of the disclosure may be devised without departing from the basic scope thereof.

The invention claimed is:

1. A method for controlling current ratio in a substrate processing chamber, the method comprising:

(a) providing a first RF signal from an RF source through a first RF coil and a second RF coil to provide a current ratio at a first current ratio set point and a first current operating mode;

(b) determining a first dynamic control limit for the first current ratio set point based on a value of the first current ratio set point and the first current operating mode;

(c) measuring an amount of current supplied to each of the first and second coils;

(d) determining a measured current ratio based on the measured amounts of current supplied to each of the first and second coils;

(e) determining whether the measured current ratio determined is within the dynamic control limits; and (f) adjusting the current ratio provided and repeating steps (b)-(e) until the measured current ratio determined is within the first dynamic control limit.

2. The method of claim 1, wherein a divider capacitor is used to split the current between the first RF coil and the second RF coil based on the first current ratio.

3. The method of claim 2, wherein a position of the divider capacitor is moved to a first divider capacitor position to achieve the first current ratio set point.

4. The method of claim 3, wherein the first dynamic control limit is determined further using the position of the divider capacitor.

5. The method of claim 1, wherein an amount of current supplied to each of the first and second coils are measured via one or more current sensors.

6. The method of claim 5, wherein a controller uses the current measured by the one or more current sensors to determine the measured current ratio.

7. The method of claim 6, wherein the measured current ratio is continually being calculated using updated current values measured by the one or more current sensors.

8. The method of claim 1, further comprising:

determining that the measured current ratio determined is within the first dynamic control limit;

stopping control of the current ratio;

continually monitoring the measured current ratio using updated current values measured by one or more current sensors to determine if the current ratio is within the first dynamic control limit; and repeating steps (b)-(e) if it is determined that the current ratio is not within the first dynamic control limit.

9. The method of claim 1, further comprising:

providing a second RF signal from the RF source through the first RF coil and the second RF coil to provide a second current ratio at a second current ratio set point and a second current operating mode;

(g) determining a second dynamic control limit for the second current ratio set point based on a value of the second current ratio set point and the second current operating mode;

(h) measuring an amount of current supplied to each of the first and second coils;

(i) determining a second measured current ratio based on the measured amounts of current supplied to each of the first and second coils;

(j) determining whether the second measured current ratio determined is within the dynamic control limits; and (k) adjusting the second current ratio provided and repeating steps (g)-(j) until the second measured current ratio determined is within the second dynamic control limit.

10. A method for controlling current ratio in a substrate processing chamber, the method comprising:

(a) providing a first RF signal from an RF source through a first RF coil and a second RF coil to provide a current ratio at a first current ratio set point and a first divider capacitor position;

(b) determining a first dynamic control limit for the first current ratio set point based on a value of the first current ratio set point and the first divider capacitor position, wherein the first dynamic control limit is a derivative of the first current ratio set point versus the first divider capacitor position;

(c) measuring an amount of current supplied to each of the first and second coils;

(d) determining a measured current ratio based on the measured amounts of current supplied to each of the first and second coils;

(e) determining whether the measured current ratio determined is within the dynamic control limits; and (f) adjusting the current ratio provided and repeating steps (b)-(e) until the measured current ratio determined is within the first dynamic control limit.

11. The method of claim 10, wherein a divider capacitor is used to split the current between the first RF coil and the second RF coil based on the first current ratio.

12. The method of claim 10, wherein a position divider capacitor is moved to the first divider capacitor position to achieve the first current ratio set point.

13. The method of claim 10, wherein the amount of current supplied to each of the first and second coils are measured via one or more current sensors.

14. The method of claim 13, wherein a controller uses the current measured by the one or more current sensors to determine the measured current ratio.

15. The method of claim 14, wherein the measured current ratio is continually being calculated using updated current values measured by the one or more current sensors.

16. The method of claim 10, further comprising:

determining that the measured current ratio determined is within the first dynamic control limit;

stopping control of the current ratio;

continually monitoring the measured current ratio using updated current values measured by one or more current sensors to determine if the current ratio is within the first dynamic control limit; and repeating steps (b)-(e) if it is determined that the current ratio is not within the first dynamic control limit.

17. The method of claim 10, further comprising:

providing a second RF signal from the RF source through the first RF coil and the second RF coil to provide a second current ratio at a second current ratio set point and a second current operating mode;

(g) determining a second dynamic control limit for the second current ratio set point based on a value of the second current ratio set point and the second current operating mode;

(h) measuring an amount of current supplied to each of the first and second coils;

(i) determining a second measured current ratio based on the measured amounts of current supplied to each of the first and second coils;

(j) determining whether the second measured current ratio determined is within the dynamic control limits; and (k) adjusting the second current ratio provided and repeating steps (g)-(j) until the second measured current ratio determined is within the second dynamic control limit.

18. The method of claim 10, wherein the first dynamic control limit is determined further using a current operating mode of the RF signal provided.

19. A non-transitory computer readable medium, having instructions stored thereon that, when executed, cause a method for controlling current ratio in a substrate processing chamber, the method comprising:

(a) providing a first RF signal from an RF source through a first RF coil and a second RF coil to provide a current ratio at a first current ratio set point and a first current operating mode;

(b) determining a first dynamic control limit for the first current ratio set point based on a value of the first current ratio set point and the first current operating mode;

(c) measuring an amount of current supplied to each of the first and second coils;

(d) determining a measured current ratio based on the measured amounts of current supplied to each of the first and second coils;

(e) determining whether the measured current ratio determined is within the dynamic control limits; and (f) adjusting the current ratio provided and repeating steps (b)-(e) until the measured current ratio determined is within the first dynamic control limit.

20. The non-transitory computer readable medium of claim 19, wherein a divider capacitor is used to split the current between the first RF coil and the second RF coil based on the first current ratio, wherein a position of the divider capacitor is moved to a first divider capacitor position to achieve the first current ratio set point, and wherein the first dynamic control limit is determined further using the position of the divider capacitor.

* * * * *